US010973266B2

(12) United States Patent
Weir et al.

(10) Patent No.: US 10,973,266 B2
(45) Date of Patent: Apr. 13, 2021

(54) HEATED GARMENT AND BATTERY HOLSTER

(71) Applicants: Robert Bosch Tool Corporation, Broadview, IL (US); Robert Bosch GmbH, Stuttgart (DE)

(72) Inventors: James Alan Weir, Lake Zurich, IL (US); Andrew Pomjin Cho, Plymouth, MN (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 786 days.

(21) Appl. No.: 14/208,399

(22) Filed: Mar. 13, 2014

(65) Prior Publication Data

US 2014/0263264 A1 Sep. 18, 2014

Related U.S. Application Data

(60) Provisional application No. 61/787,098, filed on Mar. 15, 2013.

(51) Int. Cl.
*A41D 13/005* (2006.01)
*A41D 1/00* (2018.01)
(Continued)

(52) U.S. Cl.
CPC ..... *A41D 13/0051* (2013.01); *A41D 1/005* (2013.01); *H05B 1/0272* (2013.01); *A41D 3/00* (2013.01); *A41D 27/205* (2013.01)

(58) Field of Classification Search
CPC .... A41D 13/0051; A41D 1/002; A41D 1/005; A41D 27/205; H01M 2/02;
(Continued)

(56) References Cited

U.S. PATENT DOCUMENTS 4,464,445 A * 8/1984 Matti ..... H01M 2/105 429/100
5,633,096 A * 5/1997 Hattori ..... B60R 16/04 429/100
(Continued)

FOREIGN PATENT DOCUMENTS

CN 201742967 U 2/2011
EP 0287294 A1 10/1988

OTHER PUBLICATIONS

International Search Report and Written Opinion corresponding to PCT Application No. PCT/US2014/026429, dated Jul. 10, 2014 (10 pages).
(Continued)

*Primary Examiner* — Erin E McGrath
(74) *Attorney, Agent, or Firm* — Maginot, Moore & Beck LLP

(57) ABSTRACT

A heated garment system in one embodiment includes a jacket, a wiring circuit embedded within the jacket and configured to generate heat, a battery assembly configured to removably couple with the wiring circuit, the battery assembly including a power button for selectively applying power to the wiring circuit, and a battery holder configured to removably receive the battery assembly.

20 Claims, 10 Drawing Sheets

(51) Int. Cl.
*H05B 1/02* (2006.01)
*A41D 3/00* (2006.01)
*A41D 27/20* (2006.01)

(58) Field of Classification Search
CPC ..... H01M 2220/30; H01M 2/0202; H01M 2/0205; H01M 2/022; H01M 2/10; H01M 2/1005; H01M 2/1011; H01M 2/1016; H01M 2/2033; H05B 2203/005; H05B 2203/007
USPC ..... 219/211; D13/103; 429/100
See application file for complete search history.

(56) References Cited

U.S. PATENT DOCUMENTS 5,768,371 A * 6/1998 Snyder ..... A45F 5/02 379/446
5,893,991 A 4/1999 Newell
5,986,243 A * 11/1999 Campf ..... A41D 13/0051 219/211
6,235,420 B1 5/2001 Ng
RE40,613 E 1/2009 Jordan
7,623,898 B2 * 11/2009 Holmberg ..... H04M 1/18 206/320
2005/0016982 A1 * 1/2005 Campf ..... H05B 1/0272 219/212
2008/0023460 A1 1/2008 Huang
2008/0093354 A1 4/2008 Fang et al.
2009/0289046 A1 11/2009 Richmond
2011/0108538 A1 5/2011 Gray et al.
2013/0037531 A1 2/2013 Gray et al.

OTHER PUBLICATIONS

Supplementary European Search Report corresponding to European Patent Application 14769330 (10 pages).

* cited by examiner

HEATED GARMENT AND BATTERY HOLSTER

This application claims the benefit of U.S. Provisional Application No. 61/787,098 filed Mar. 15, 2013, the entirety of which is incorporated herein by reference.

FIELD

This disclosure relates to cold weather gear.

BACKGROUND

Workers, hunters, hikers, and other individuals are frequently required to be in locations which expose the individuals to extreme weather. In conditions where the individual is exposed to cold weather, the individual frequently needs to don several layers of clothing in order to stay warm. Such layering, while effective, can significantly hinder the ability of the individual to perform tasks. Moreover, layering typically cannot be accomplished for extremities such as the hands and ears. Accordingly, even when wearing gloves, an individual can become uncomfortably and even dangerously cold.

What is needed is cold weather gear which provides warmth without requiring excessive layering of garments.

SUMMARY

In accordance with one embodiment, a heated garment system includes a jacket, a wiring circuit embedded within the jacket and configured to generate heat, a battery assembly configured to removably couple with the wiring circuit, the battery assembly including a power button for selectively applying power to the wiring circuit, and a battery holder configured to removably receive the battery assembly.

In accordance with another embodiment, a method of operating a heated garment system includes inserting a battery assembly into a battery holder, supporting the battery holder with a jacket, coupling the battery assembly with a wiring circuit embedded in the jacket, applying power to the wiring circuit using a power button of the battery assembly, and generating heat with the wiring circuit.

DESCRIPTION

Figure 2:
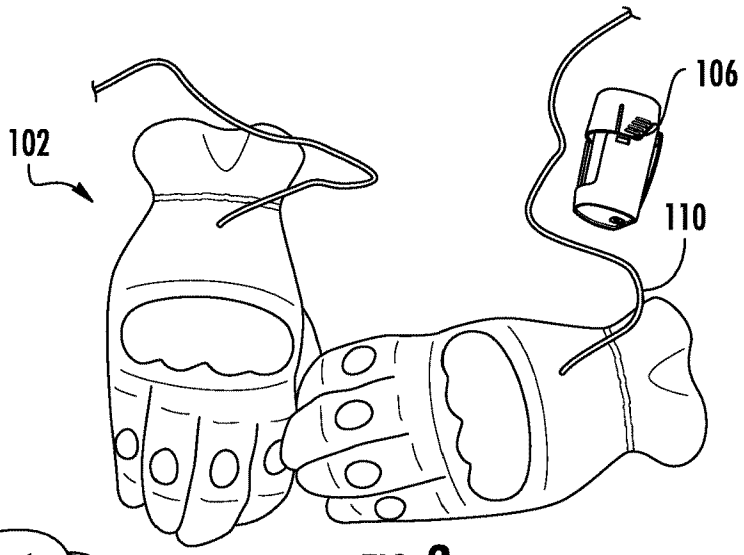
FIG. 2 depicts a portion of the electrically heated garments of FIG. 1.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one skilled in the art to which this disclosure pertains.

Figure 3:
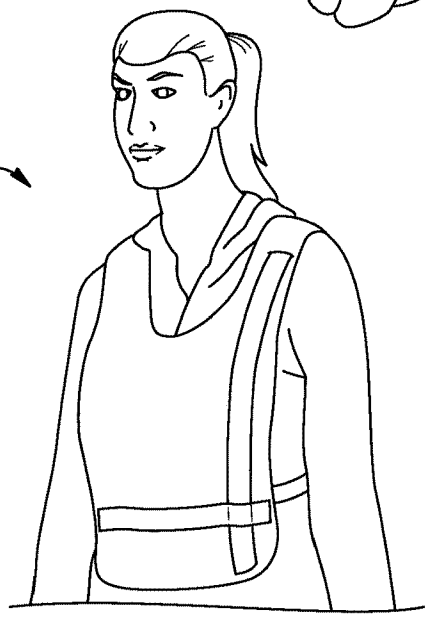
FIG. 3 depicts an electrically heated vest
Figure 1:
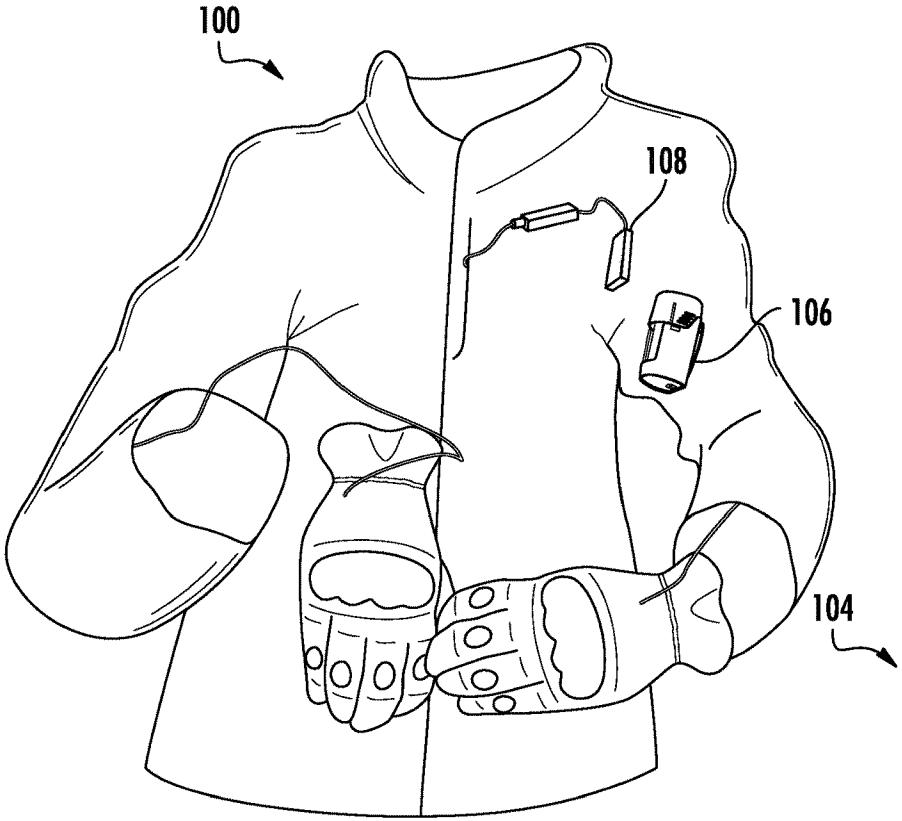
FIG. 1 depicts electrically heated garments in accordance with principles of the disclosure.

FIG. 1 depicts a heated jacket 100, FIG. 2 depicts a pair of heated gloves 102, and FIG. 3 depicts a heated vest 104 which in some embodiments includes a lighting system. Each of the garments in FIGS. 1-3 is electrically heated. The electricity is provided by a battery assembly 106 through wiring 110 (the battery assembly 106 is shown disconnected from the wiring 110 in FIGS. 1 and 2). The wiring 110 is used to provide electricity to other garments such as the gloves 102, the vest 104 (see FIG. 3), ear muffs (not shown), a hat (not shown), etc. The battery assembly 106 is further used to provide power to electronic devices such as the electronic device 108 of FIG. 1.

Figure 4:
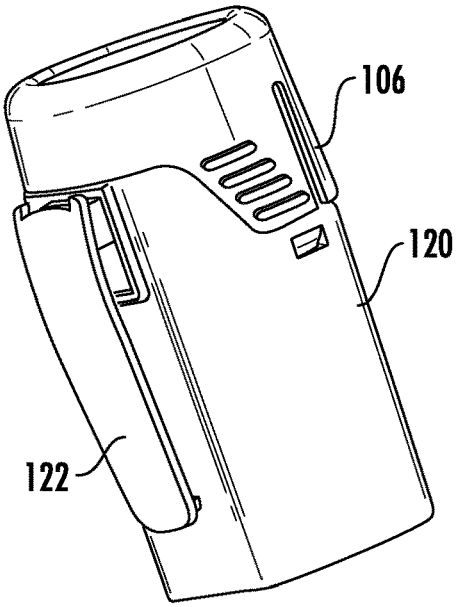
FIG. 4 depicts a side perspective view of the battery assembly and holder of FIG. 1.
Figure 5:
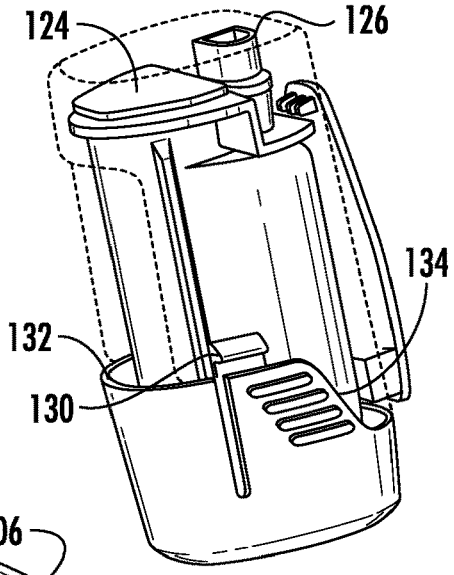
FIG. 5 depicts the battery assembly and holder of FIG. 4 with a portion of the battery holder removed to show features of the battery assembly.
Figure 6:
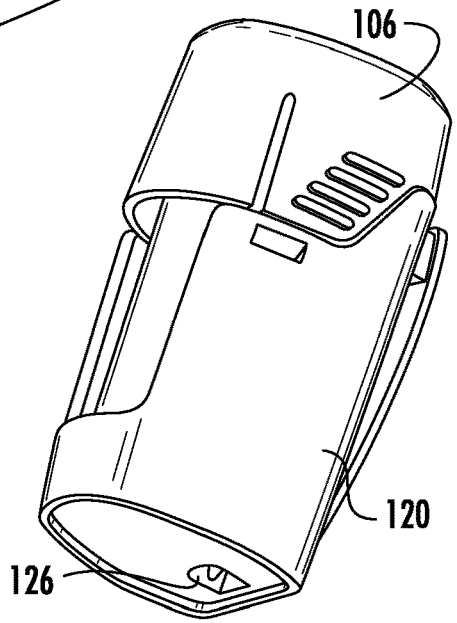
FIG. 6 depicts a side perspective view showing a portion of the bottom of the battery assembly and holder of FIG. 1.
Figure 7:
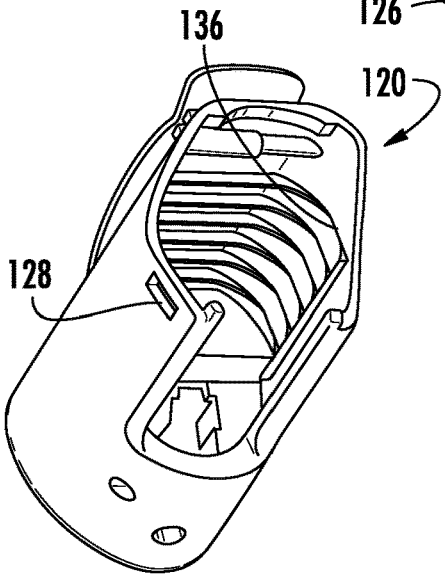
FIG. 7 depicts a top perspective view of the battery holder of FIG. 1 with the battery assembly removed.
Figure 8:
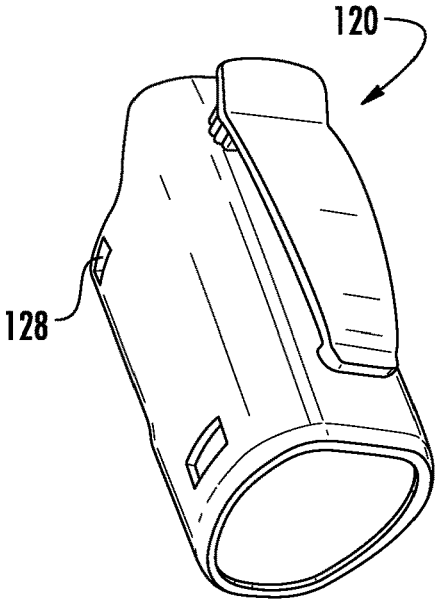
FIG. 8 depicts a bottom perspective view of the battery holder of FIG. 1 with the battery assembly removed.

The battery assembly 106 is shown in more detail in FIG. 4 positioned within a holder 120. The holder 120 includes a clip 122 so that it can be worn on a belt, placed within a pocket which in some instances is specially made to receive the holder 120, or simply attached at some other location of the garment. A portion of the housing of the holder 120 is removed in FIG. 5 to show a power button 124 which can be used to turn the heating portion of the garments on and off as discussed more fully below, along with a port 126 which receives a plug attached to the wiring 110. The holder is shown in FIGS. 7 and 8 without a battery assembly 106 installed.

The holder 120 includes two latches 128 which receive lips 130 on the battery assembly 106. The lips 130 are located on a resilient flange 132 which is provided with grip portions 134. By compression of the flange 132 at the grip portions 134 the lips 130 are moved out of the latches 128 allowing the battery assembly 106 to be removed from the inner cavity 136 of the holder 120. In the embodiment of FIGS. 4-8, the latches 128 are through holes. In other embodiments the latches are indentations in an inner surface of the holder 120. The clip 122 is oriented such that when used to attach the holder 120 to the jacket 100, the port 126 is accessible through an opening in the bottom of the holder 120. The bottom of the holder in one embodiment includes a resilient portion which allows the power button 124 to be manipulated without removing the battery assembly 106 from the holder 120.

The battery assembly 106 includes a 10.8V Lithium Ion battery, although other batteries are used in other embodiments. The battery assembly 106 provides about 7-8 hours of operation, and the garments themselves are washable and easily removed/donned. The garments can be used wherever warmth is desired using light weight and active garments. Some activities which benefit from the garments disclosed herein include construction, hunting, fishing, hiking, biking, etc. Even spectators at outdoor activities can benefit from the disclosed garments. In some embodiments, lighting such as LED lighting is also powered by the battery assembly 106.

The power from the battery assembly 106 supplies a garment circuit 150 which is shown in FIGS. 9-17. In FIGS. 9-17, the system component are defined as follows: "B+" is the + pole of the battery assembly 106; "B−" is the negative pole of the battery assembly 106; "U1" is the system control MCU; "U2" is 7550 +5V voltage regulator that supplies regulated +5V for system use; "U3" is a DC/DC converter for USB +5V output; Q1 is DC output to Heating Core control switch N-MOSFET; "Q2" is system power control switch, P-MOSFET; "Vcc" is system power from B+ (see J1); and "12V" is the symbol of DC output through JP1 to heating core, not real 12V output, it will be varied by B+.

In the system MCU U1, the following definitions are used: "P1" is VDD, +5V, MCU power source from U2; "P2" USB LOAD, activate U3 when detects a load connect to USB port; "P3" 12V LOAD, enable DC output controlled by Q1 after "battery check" is correct; "P4" BUTTON, USB enable control switch, turn on USB for 120 minutes each time when button is pushed; "P5" SYSTEM_ON, system power switch, detects the voltage between Vcc and B−, when battery is lower than 8.25V, assign Q2 to shut down the whole system, interact with P3; "P6" NC, status indicator LED, for internal production test; "P7" sharing pin with indicator LED (if any), detect any loading connect to USB port, if yes, enable USB output, if not, then disable, this pin is interactive with P2; "P8" ANT, detect NTC resistance to protect battery; "P9" USB_OVER_L, detect USB current output, if >900 ma, disable USB output, interact with P2; "P10" DC AD, detect input of DC Jack, interact with P11; "P11" DCTEST, detect input of DC Jack, interact with P10; "P12" 12V_OVER_L, detect current of DC output, if >2.0A, disable the DC output through Q1, interact with P3; "P13" ANB, detects the battery low voltage 8.25V, interact with P5; and "P14" VSS.

Figure 9:
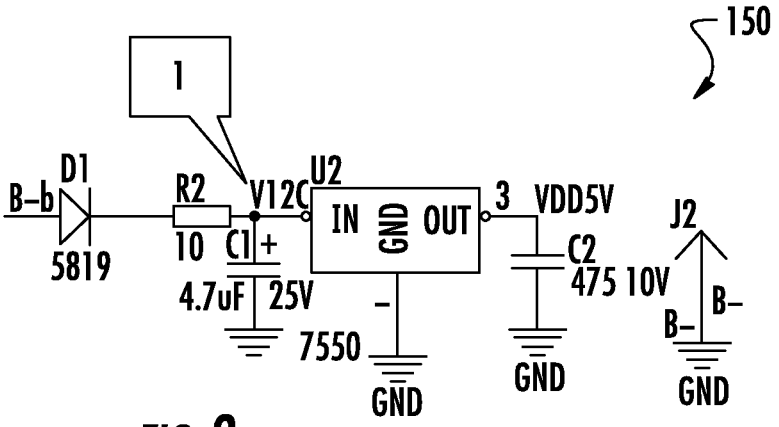
FIGS. 9-17 depict schematics of the garment circuit of the garment of FIG. 1.
Figure 10:
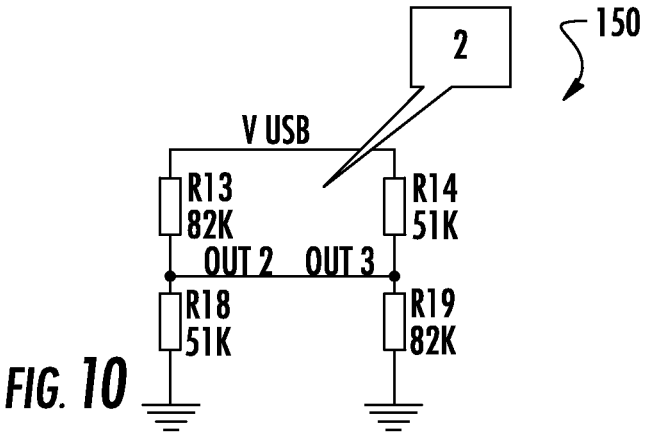

With the foregoing definitions, the garment circuit 150 is further described with initial reference to FIG. 9 wherein reference number "1" indicates the system Vcc from B+. In FIG. 10, reference number "2" indicates the fixed voltage level of USB data line, to ensure i-Phone and i-PAD can be charged (these two pins in USB port cannot be floating, otherwise i-Phone sometimes might not be enabled in the charged state.

Figure 11:
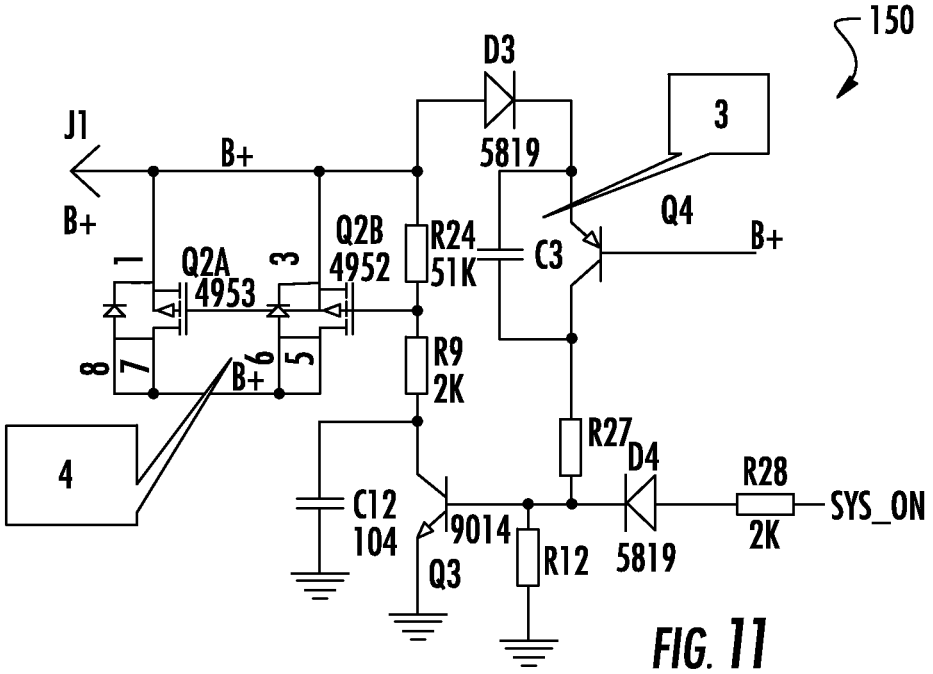
Figure 12:
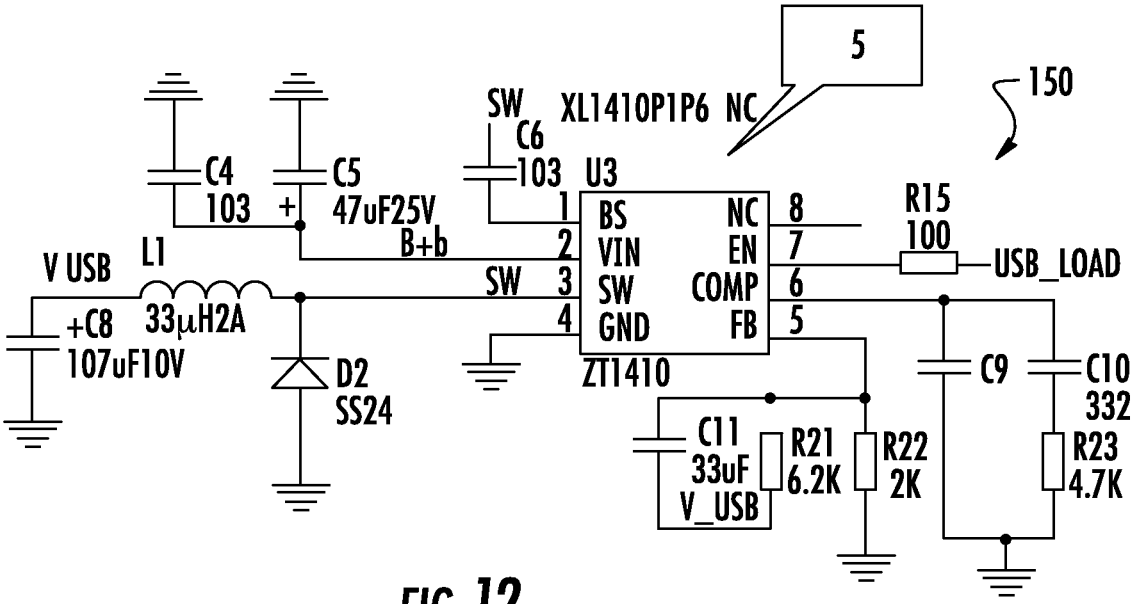
Figure 13:
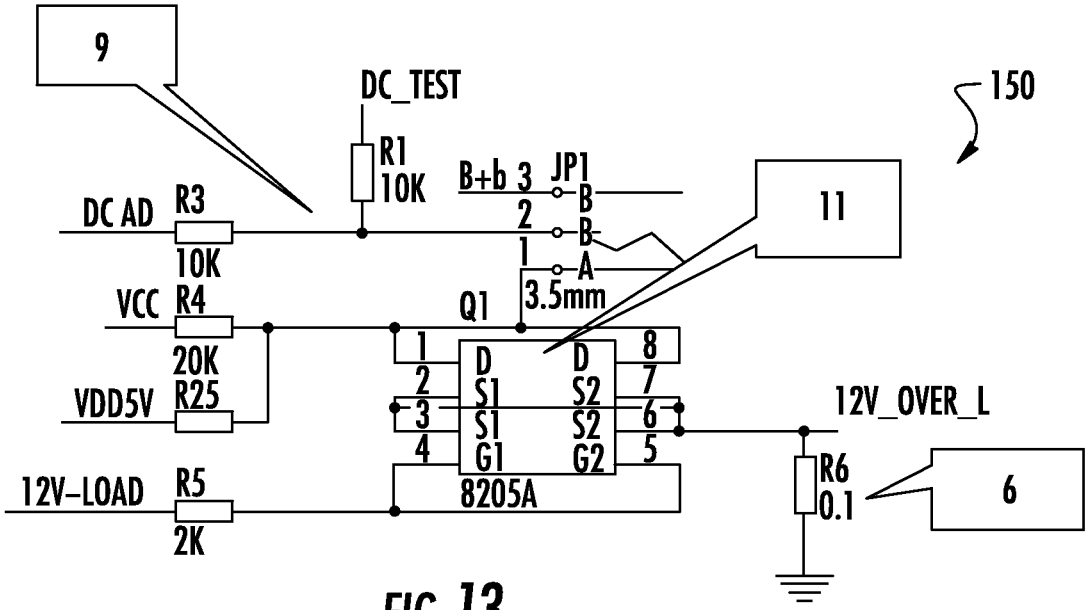

In FIG. 11, reference number "3" indicates the system wake-up circuit from cutoff state when the battery voltage is lower than 8.3V and reference number "4" indicates the system power control block, P-MOSFET circuit to B+. In FIG. 12, reference number "5" indicates is the DC to DC converter for USB output. FIG. 13 includes reference number "6" which indicates a DC jack output overload detection point (<2A, 1.9A preset in design), and reference number "9" which is DC jack status verification, by checking the Pin state of both P10 and P11 to ensure the DC jack input and Q1 output is correct which corresponds to the following four statuses:

| | |
|---|---|
| DC jack connected with load | Q1 ON |
| DC jack connected with load | Q1 OFF |

-continued

| | |
|---|---|
| DC jack without load | Q1 ON |
| DC jack without load | Q1 OFF. |

FIG. 13 also includes reference number "11" indicates which is DC Jack output control block, N-MOSFET circuit to B+.

Figure 14:
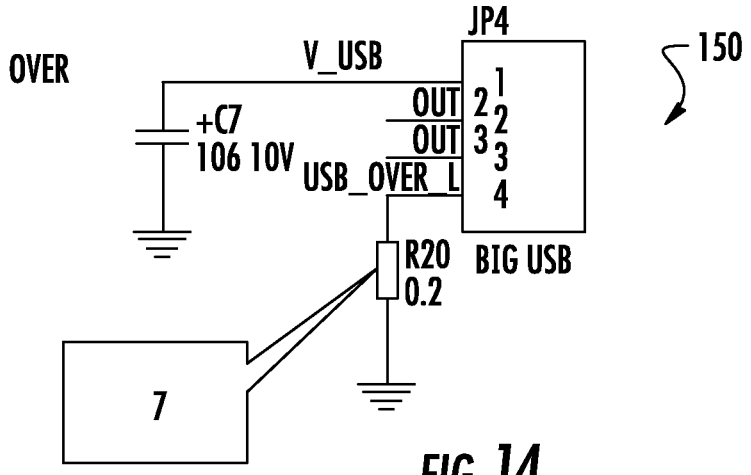
Figure 15:
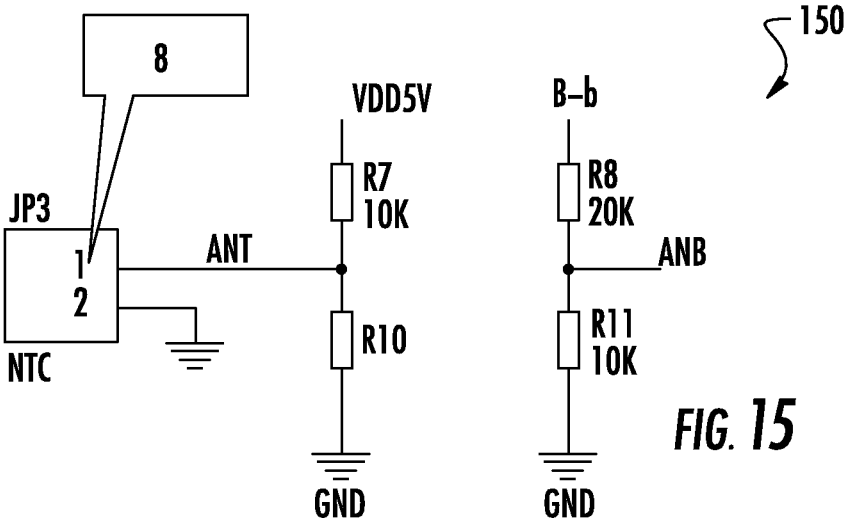
Figure 16:
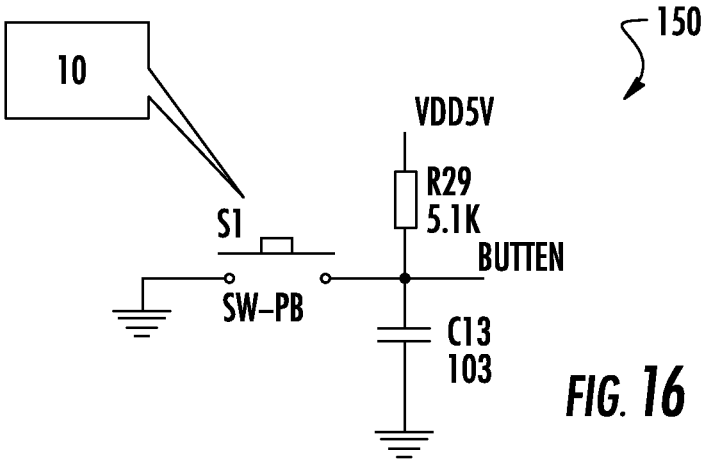

In FIG. 14, reference number "7" indicates a USB output overload detection point (<1A, 0.9A preset in design). In FIG. 15, reference number "8" indicates a NTC detection point (NTC terminal on battery pack connects to Pin 1 of JP3. By redesign, the system power control from B− to B+ to avoid the leakage current in NTC circuit loop at cutoff state). In FIG. 16, reference number "10" indicates a USB turn on switch, turns on USB port for 120 minutes each time when push button is pushed. Each time when button is pushed, the USB port will be turned on for 10 seconds to check any loading connects to the USB port. If yes, USB port will stay on for 120 minutes. If no, the USB port will be turned off to avoid unexpected push of the button.

Figure 17:
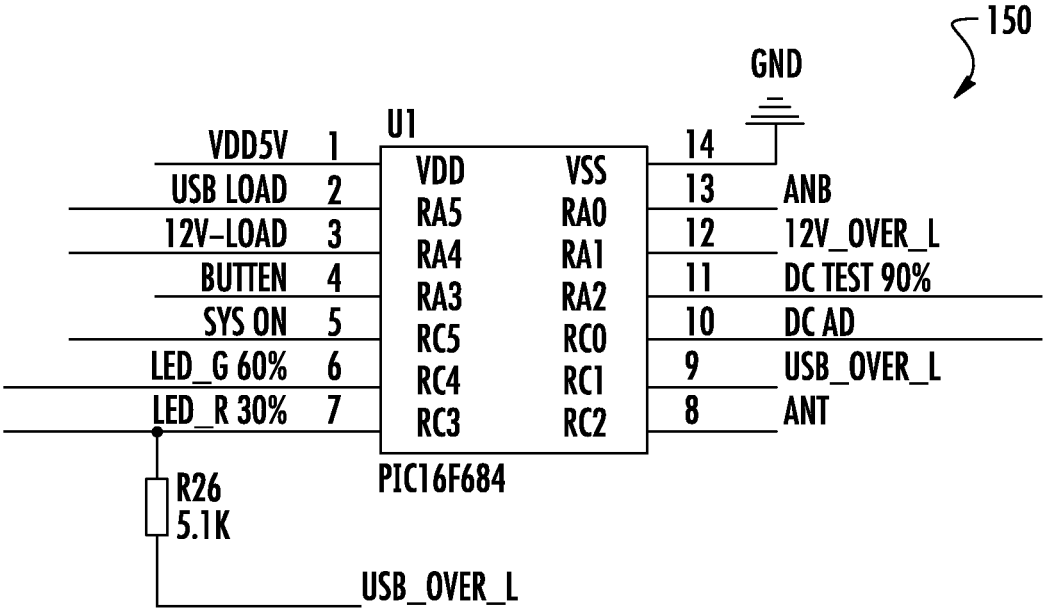

Additional detail of the circuit 150 is shown in FIG. 17.

The heated jacket 100 thus provides the wiring an circuitry to accommodate a variety of electronic devices while providing a heated garment. The heated jacket 100 is also powered by a rechargeable battery. The heated jacket 100 is configured to be technology friendly in other ways.

Figure 18:
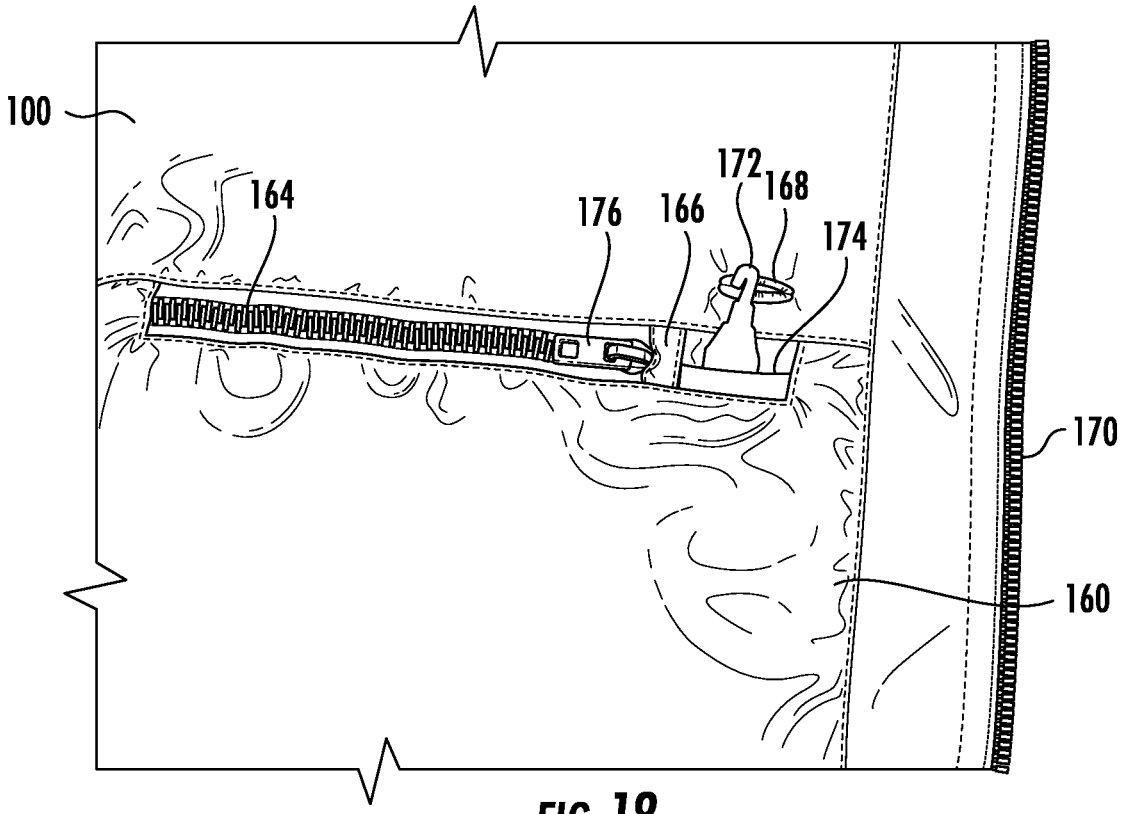
FIG. 18 depicts a zippered pocket and eyelet on an inner side of the jacket of FIG. 1.

By way of example, FIG. 18 depicts an inner pocket 160. The inner pocket 160 is located on an inner surface of the jacket 100. A pocket zipper 164 is provided to substantially seal the inner pocket 160 from direct access. A stop strip 166 extends over the zipper 162. An eyelet 168 located adjacent to the stop strip 166 provides a passage from inside of the jacket 100 to a pocket (not shown) which is directly accessed from outside of the jacket 100.

Figure 19:
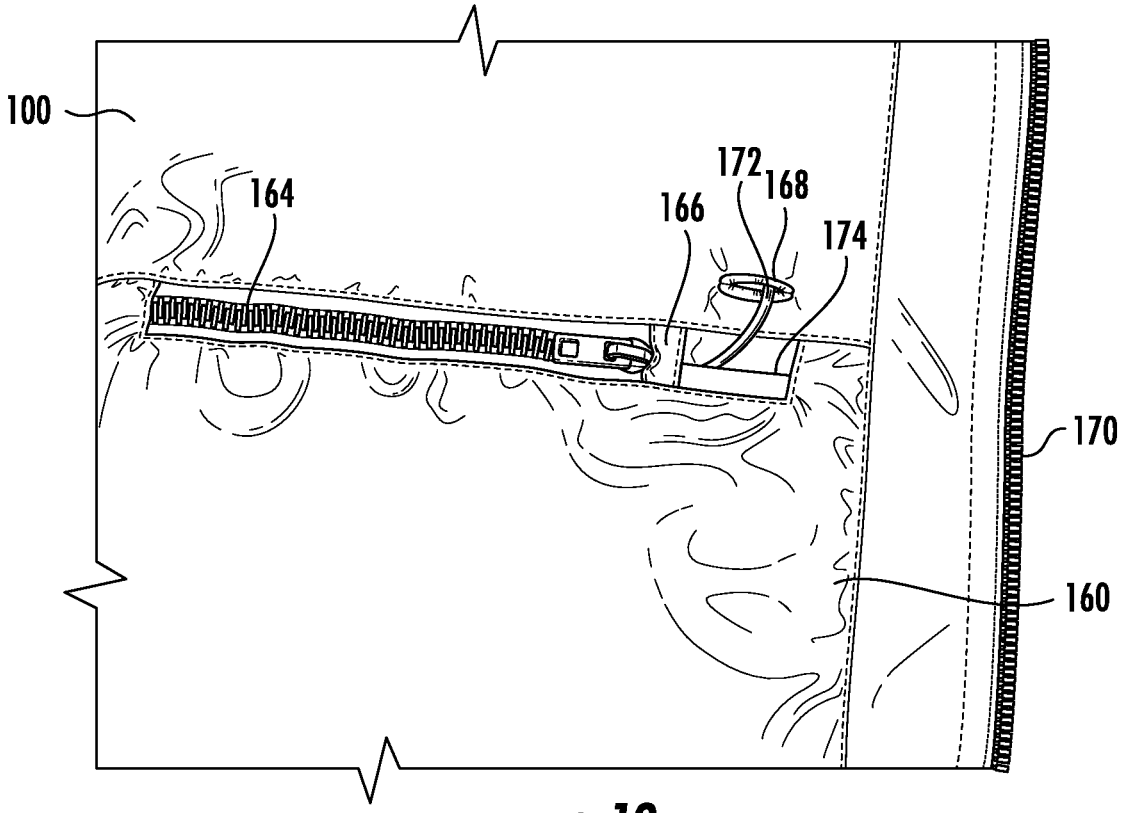
FIG. 19 depicts the pocket of FIG. 18 with the zipper shut to a stop strip which allows a wire portion of a wired device to extend out of the pocket without being damaged by the zipper.

Accordingly, when the main zipper 170 of the jacket 100 is fully zipped, the inner pocket 160 is effectively isolated from outside of the jacket 100. Wired access to the pocket 160 from outside off the jacket 100 is provided, however, by the eyelet 168. For example, a wired device such as the wired device 172 in FIG. 18 can be threaded through the eyelet 168 from the outer pocket (not shown) or from inside the jacket 100. The wired device 172 is also passed through an open portion 174 of the zipper 162 and into the pocket 160 as shown in FIG. 19. The stop strip 164 prevents the slider 176 of the zipper 164 from completely closing, thereby protecting the wired device 172 from damage. Accordingly, even with the jacket 100 fully zippered, wired access is provided between an inner zippered pocket 160 and an outer pocket (not shown). In some embodiments, the wired device 172 is a USB or other cable which can be used to power an electronic device positioned in the outer pocket.

Figure 20:
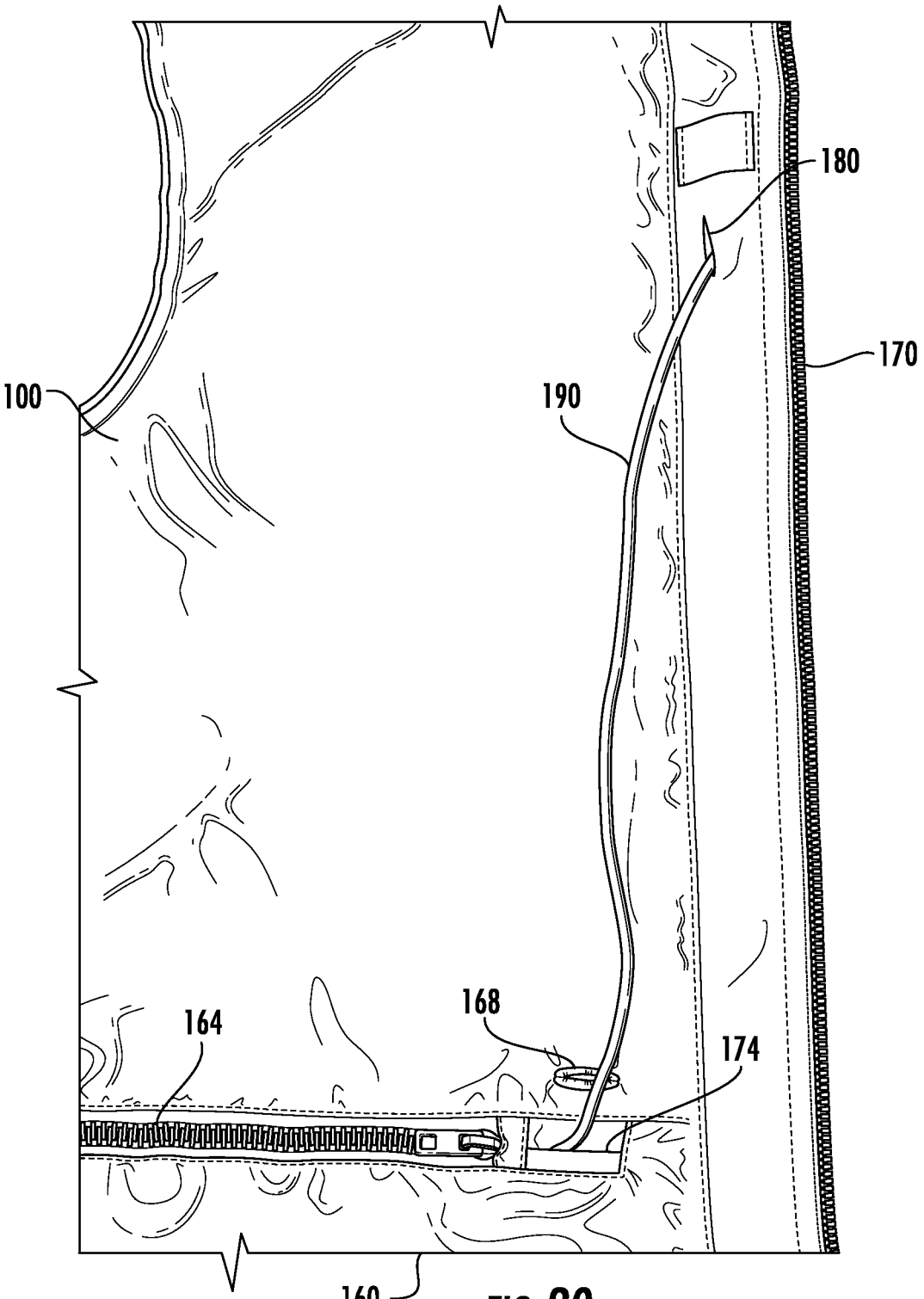
FIG. 20 depicts a second eyelet on the inner side of the jacket of FIG. 1.
Figure 21:
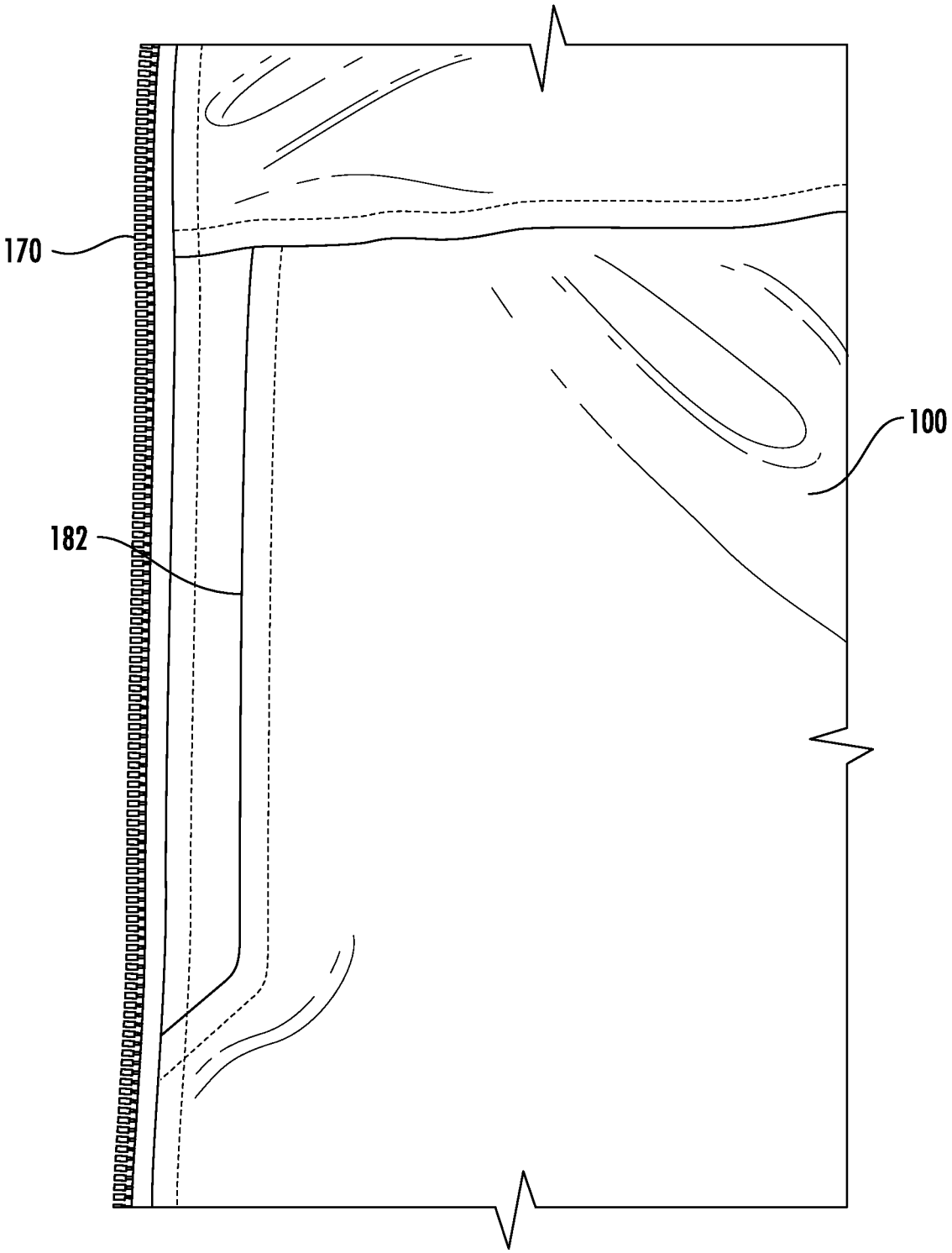
FIG. 21 depicts a portion of the outer side of the jacket of FIG. 1 showing a flap covering the eyelet of FIG. 20.
Figure 22:
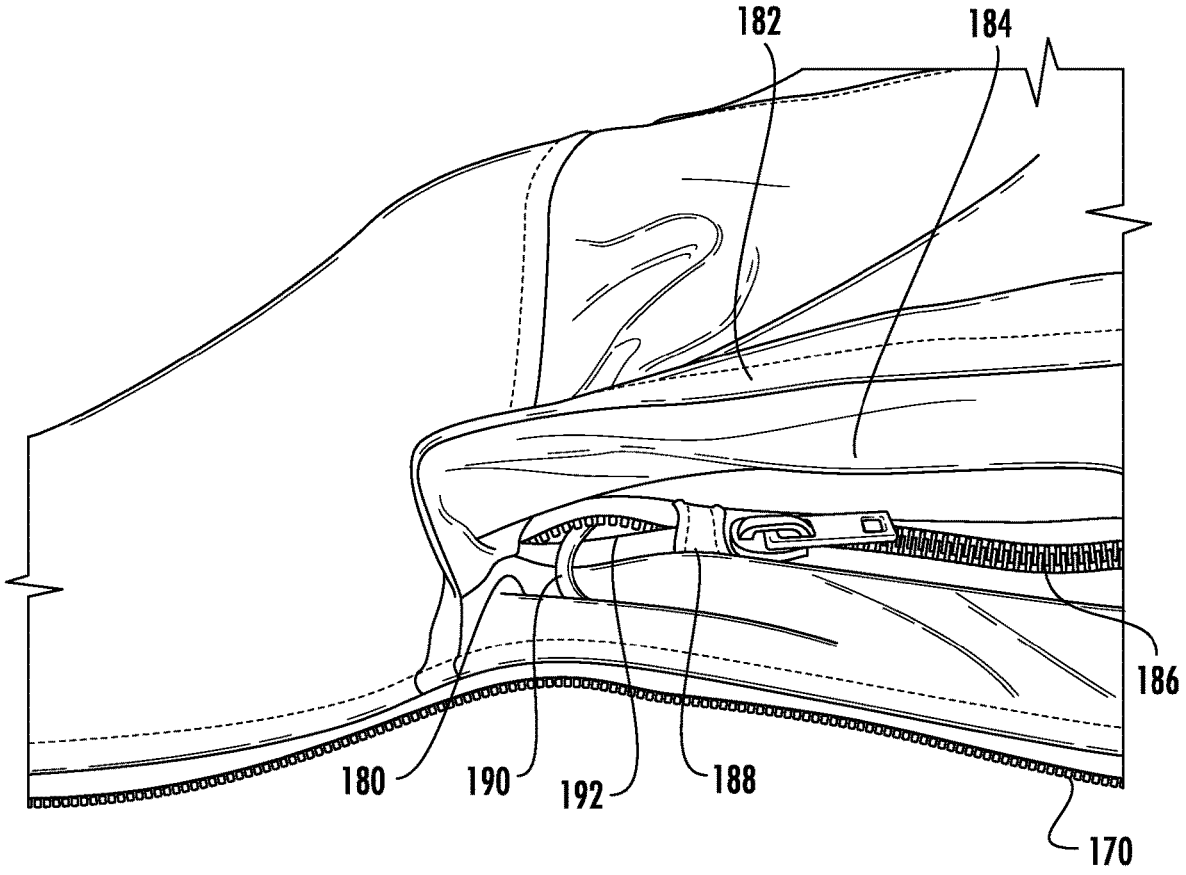
FIG. 22 depicts a pocket under the flap of FIG. 21 with the zipper shut to a stop strip which allows a wire portion of a wired device to extend out of the pocket without being damaged by the zipper.

The heated jacket 100 further includes an eyelet 180 shown in FIG. 20. The eyelet 180 extends from within the jacket 100 to a location outside of the jacket 100. On the outer side of the jacket 100, the eyelet 180 is covered by a flap 182 (see FIG. 21). The flap 182 inhibits the flow of air through the eyelet 180 and further covers an external pocket 184 (FIG. 22). A zipper 186 and a stop strip 188 are provided for the pocket 184.

The eyelet 180 is used in much the same manner as the eyelet 168. Thus, when the main zipper 170 of the jacket 100 is fully zipped, the inner pocket 160 is effectively isolated from outside of the jacket 100. Wired access to the pocket 160 from outside off the jacket 100 is provided, however, by the eyelet 180. For example, a wired device such as the wired device 190 in FIG. 22 can be positioned safely within the pocket 184 and the cable threaded through an open portion 192 of the zipper 186, through the eyelet 180, through the open portion 172 of the zipper 162 and into the pocket 160 as shown in FIG. 22. The stop strip 164 prevents the slider 174 of the zipper 160 from completely closing, thereby protecting the wired device 170 from damage. while the stop strip 188 functions in the same manner. Accordingly, even with the jacket 100 fully zippered, wired access is provided between an inner zippered pocket 160 and an outer zippered pocket.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. A heated garment system, comprising:

a jacket;

a wiring circuit embedded within the jacket and configured to generate heat;

a battery assembly configured to removably couple with the wiring circuit, the battery assembly including a power button for selectively applying power to the wiring circuit; and a battery holder configured to removably receive the battery assembly, wherein:

the battery holder includes a first end portion defining a first opening to a cavity and a second end portion defining a second opening to the cavity; and the battery assembly includes a coupler configured to align with the second opening when at least a portion of the battery assembly is inserted through the first opening and into the cavity.

2. The heated garment system of claim 1, wherein the battery holder further comprises:

a clip configured to attach the battery holder to the jacket.

3. The heated garment system of claim 2, wherein the clip is configured such that the second end portion is located downwardly of the first end portion when the battery holder is attached to the jacket and the jacket is in an upright position.

4. The heated garment of claim 1, wherein the jacket comprises:

an inner side;

an outer side; and at least one eyelet providing a path between the inner side and the outer side.

5. The heated garment of claim 4, the jacket further comprising:

a first pocket having a first pocket opening;

a first zipper along the first pocket opening; and a first stop strip positioned over the first zipper, such that a portion of the first zipper cannot be closed using a first slider of the first zipper.

6. The heated garment of claim 5, wherein the first pocket opening opens an inner portion of the first pocket to the inner side of the jacket.

7. The heated jacket of claim 6, further comprising:

a second pocket having a second pocket opening which opens an inner portion of the second pocket to the outer side;

a second zipper along the second pocket opening; and a second stop strip positioned over the second zipper, such that a portion of the second zipper cannot be closed using a second slider of the second zipper.

8. The heated jacket of claim 7, further comprising a third pocket, wherein:

the third pocket includes an opening which opens to the outer side;

the at least one eyelet comprises a first and a second eyelet; and the first eyelet extends between the inner side and the third pocket.

9. The heated jacket of claim 5, further comprising:

a USB cable configured to be removably coupled to the battery assembly.

10. The heated garment system of claim 1, wherein:

the second end portion andthe battery assembly are configured such that when the battery assembly is received within the cavity, a user can manipulate the power button through the second end portion.

11. The heated garment system of claim 1, wherein the second opening is located in a bottom portion of the battery holder and the first opening is located at least partially at a top portion of the battery holder.

12. The heated garment system of claim 1, wherein:

the battery assembly further comprises a flange, and at least one lip extending from the flange; and the battery holder further comprises at least one latch, the at least one latch configured to removably receive the at least one lip, such that when the at least one lip is removed from the at least one latch, the battery assembly is removable from the battery holder.

13. A method of operating a heated garment system, comprising:

inserting at least a portion of a battery assembly into a battery holder;

supporting the battery holder with a jacket;

coupling the battery assembly with a wiring circuit embedded in the jacket;

applying power to the wiring circuit using a power button of the battery assembly; and generating heat with the wiring circuit, wherein inserting the battery assembly into the battery holder comprises:

aligning the battery assembly with a cavity defined in a first end portion of the battery holder;

inserting at least a portion of the battery assembly into the cavity through a first opening; and aligning a coupler of the battery assembly with a second opening to the cavity in a second end portion of the battery holder.

14. The method of claim 13, wherein supporting the battery holder with the jacket comprises:

clipping the battery holder to the jacket using a battery holder clip.

15. The method of claim 14, wherein clipping the battery holder comprises:

clipping the battery holder such that the second end portion is located downwardly of the first end portion.

16. The method of claim 15, further comprising:

inserting a portion of a wired device into a first pocket having a third opening;

moving a first zipper along the third opening; and stopping a first slider of the first zipper with a first stop strip positioned over the first zipper, such that a portion of the first zipper cannot be closed, wherein the portion of the wired device extends through the portion of the first zipper that cannot be closed.

17. The method of claim 15, wherein the wired device is a USB cable, the method further comprising:

coupling the USB cable to the battery assembly.

18. The method of claim 13, wherein coupling the battery assembly with a wiring circuit comprises:

coupling the battery system with the wiring circuit through the second opening in the second end portion.

19. The method of claim 13, wherein inserting the battery assembly into the battery holder comprises:

aligning the power button with a resilient portion of the second end portion.

20. The method of claim 19, wherein applying power to the wiring circuit comprises:

manipulating the power button through the resilient portion.

* * * * *